US007442901B2

(12) United States Patent
Kim et al.

(10) Patent No.: US 7,442,901 B2
(45) Date of Patent: Oct. 28, 2008

(54) ELECTRIC OVEN AND METHOD OF OPERATING THE SAME

(75) Inventors: Yang Kyeong Kim, Boocheon-si (KR); Jae Kyung Yang, Seoul (KR); Dong Seong Kwag, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/459,706

(22) Filed: Jul. 25, 2006

(65) Prior Publication Data

US 2007/0029312 A1 Feb. 8, 2007

(30) Foreign Application Priority Data

Jul. 25, 2005 (KR) ..... 10-2005-0067435

(51) Int. Cl.
*A21B 1/00* (2006.01)
*A47J 27/00* (2006.01)

(52) U.S. Cl. ..... 219/394; 219/392; 219/385; 219/386; 219/387; 219/412; 219/413; 219/414; 219/400; 248/250; 126/335; 126/332; 126/339; 99/444; 99/445; 99/446; 99/450; 99/400

(58) Field of Classification Search ..... 219/392, 219/394, 385–7, 412–4, 400; 248/250; 126/332, 126/337 R, 339; 99/444–6, 450, 400
See application file for complete search history.

(56) References Cited

U.S. PATENT DOCUMENTS

| | | | | |
|---|---|---|---|---|
| 5,618,458 | A * | 4/1997 | Thomas | 219/394 |
| 6,545,251 | B2 * | 4/2003 | Allera et al. | 219/394 |
| 6,864,468 | B2 | 3/2005 | Kim et al. | |
| 7,071,448 | B1 * | 7/2006 | Kim et al. | 219/394 |

* cited by examiner

*Primary Examiner*—Shawntina Fuqua
(74) *Attorney, Agent, or Firm*—Greenblum & Bernstein, P.L.C.

(57) ABSTRACT

An electric oven includes an oven body, a first convection system having a first convection heater and a first convection fan that are installed in the oven body to operate for a first space in the oven body, and a second convection system having a second convection heater and a second convection fan that are installed in the oven body to operate for a second space in the oven body. Further, the first and second convection fans are driven by a single common driving unit.

7 Claims, 6 Drawing Sheets

【 Figure 1】
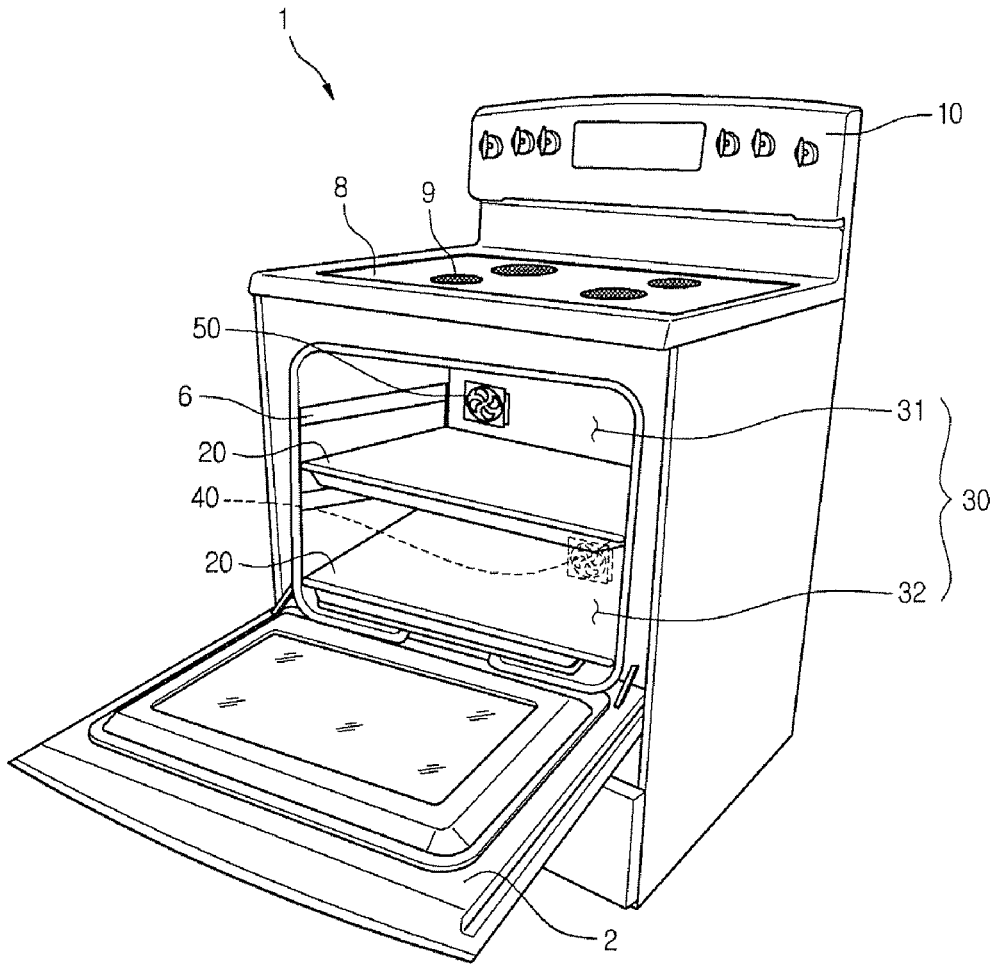

【 Figure 2】
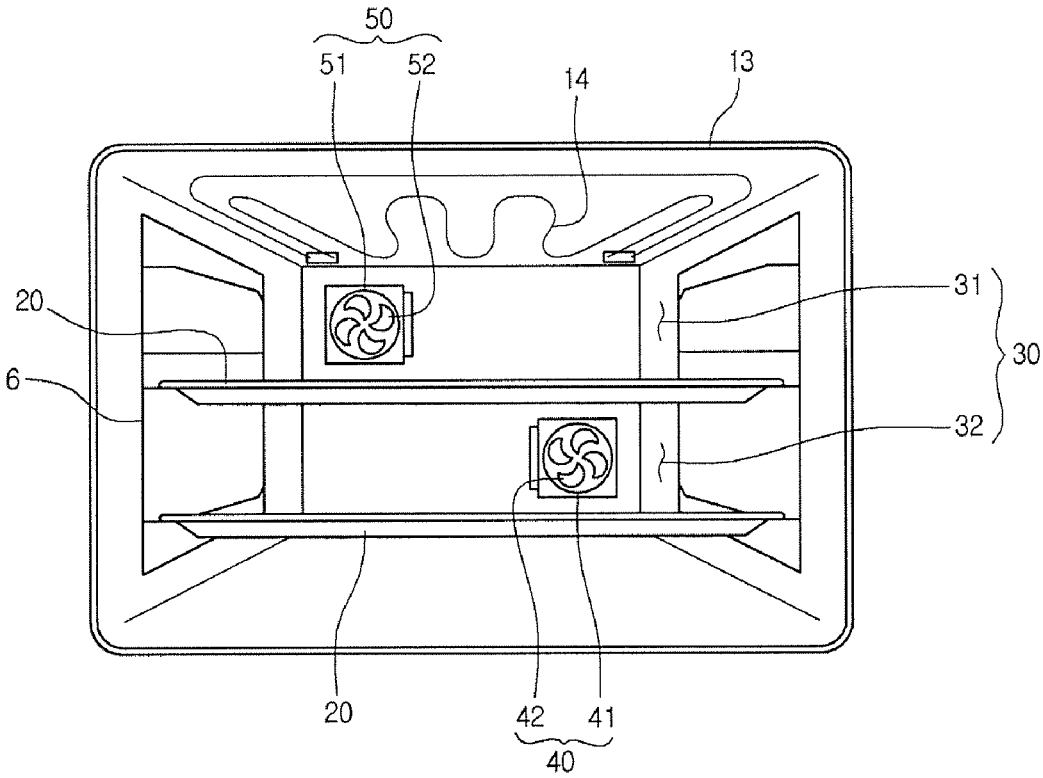

【 Figure 3】
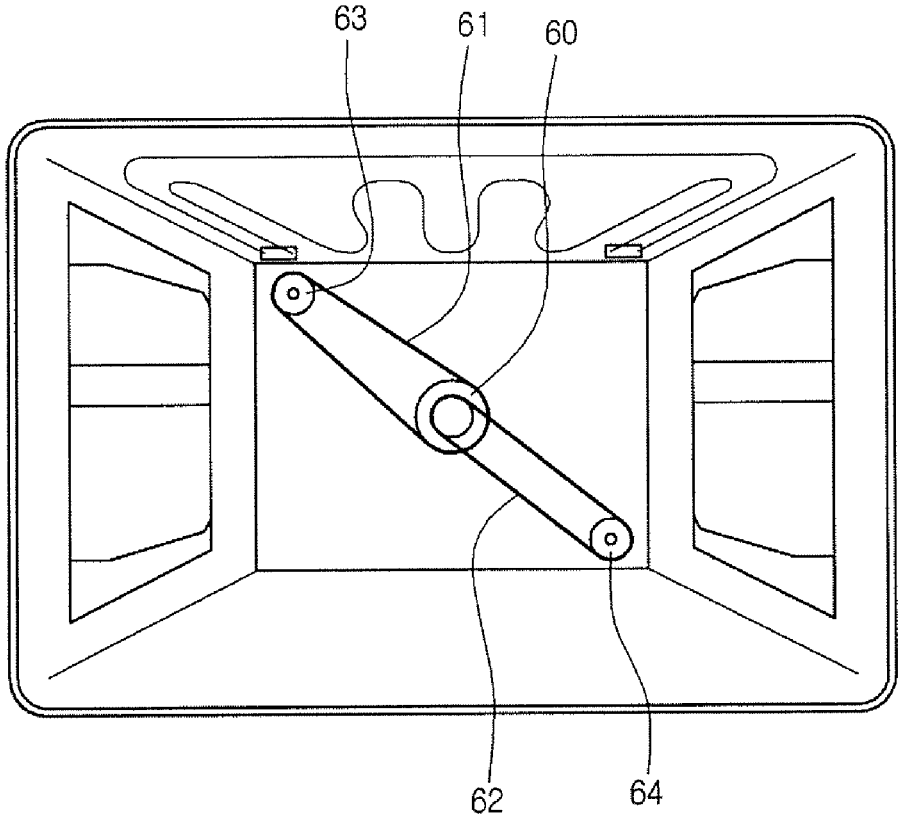

【 Figure 4】
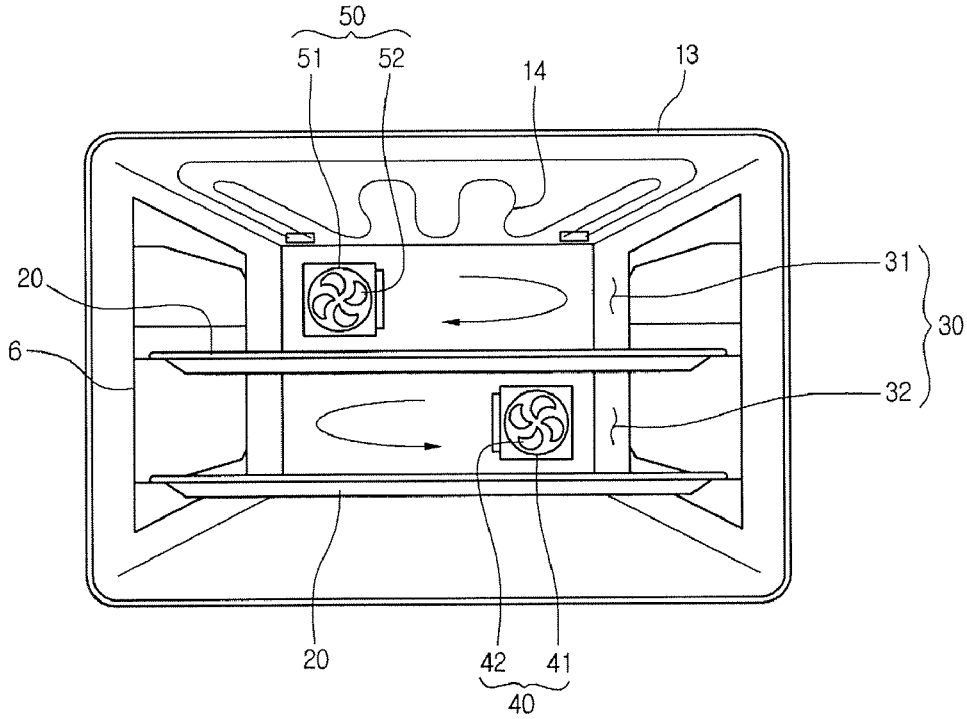

【Figure 5】
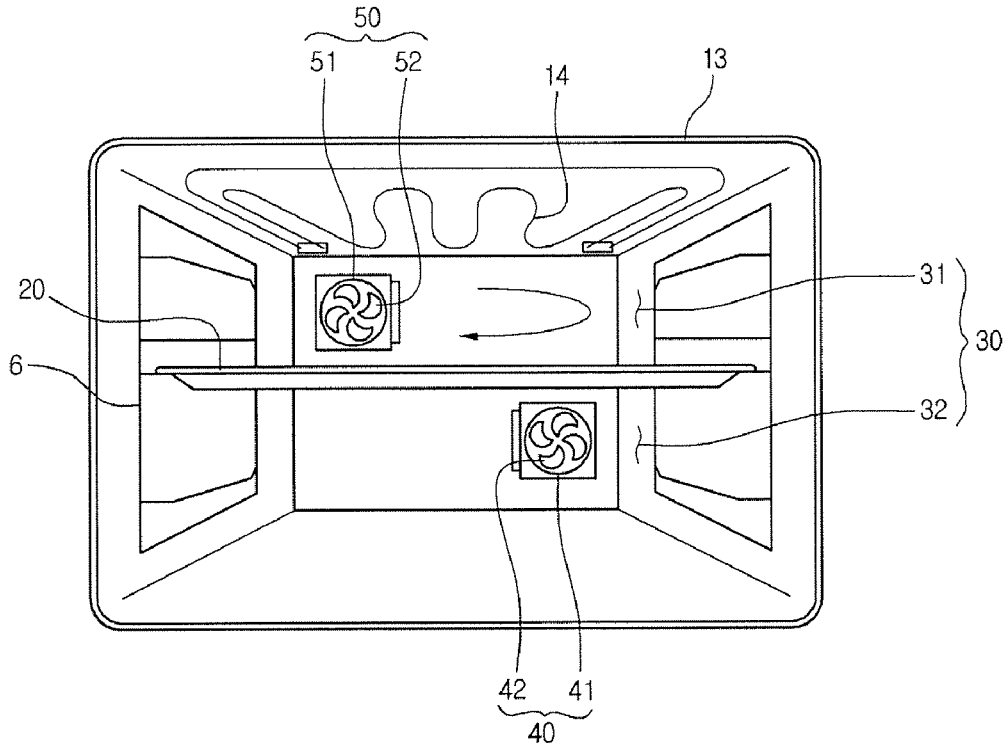

【Figure 6】
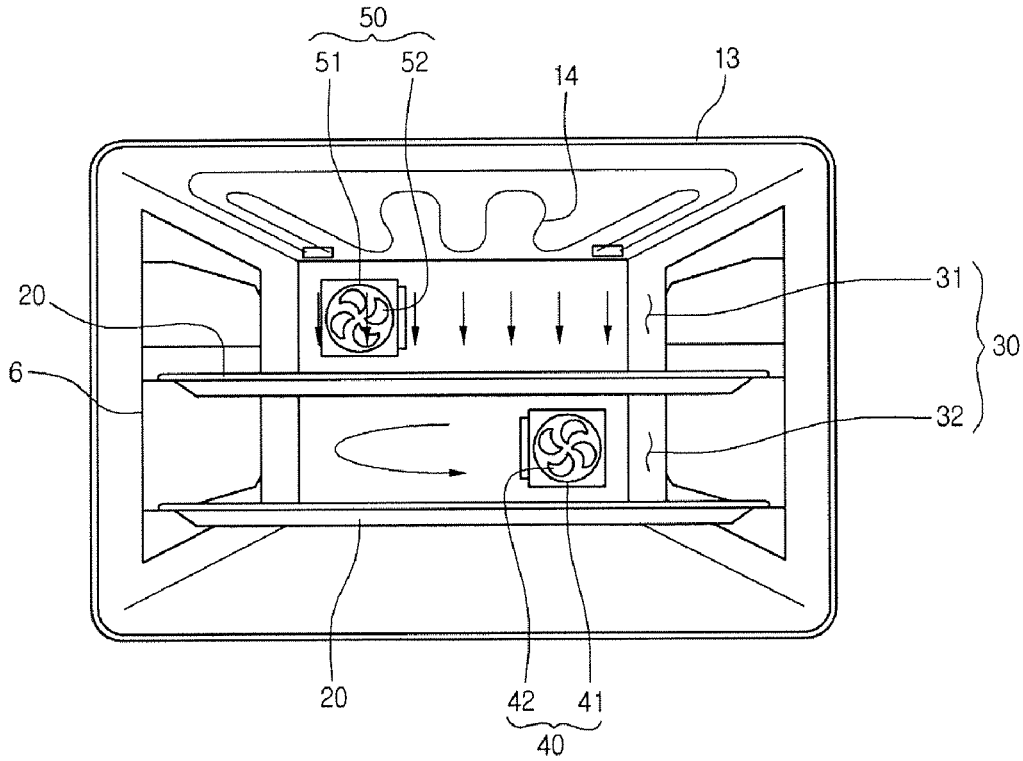

ELECTRIC OVEN AND METHOD OF OPERATING THE SAME

BACKGROUND OF THE INVENTION

1. Field of the Invention

The present invention relates to an electric oven, and more particularly, to an electric oven that can cook different types of foods and a method of operating the electric oven.

2. Description of the Related Art

An electric oven is generally used for baking or roasting food by heating the food above 100° C. using heat and steam generated from the food and confined in the oven. Therefore, the food can be cooked with a good taste without being burnt or hardened by contraction, which caused when the food is directly roasted by fire.

A typical electric oven is disclosed in U.S. Pat. No. 5,618,458. The detailed description of the typical electric oven will be omitted herein.

Meanwhile, a conventional electric oven includes a top heater used for grilling and a convection heater and convection fan used for baking. In addition, the conventional electric oven includes a bottom heater for improving an operation efficiency of the cavity during cooking.

Generally, each of the convection heater and the convection fan is installed on a rear surface of the cavity as a one unit. The baking is performed by the convection heater and the convection fan.

However, it is intended to simultaneously cook different types of foods in the conventional electric oven, the different types of the foods cannot be properly cooked due to a different cooking condition according to the type of the food or the smells of the foods may be mixed with each other.

In addition, in the conventional electric oven, when it is intended to bake only one type of food, the food is disposed on different stages. In this case, it is difficult to uniformly heat the food disposed on different stages.

Even when it is intended to bake a relatively small amount of food, the cavity must be fully filled with high performance air. This cases the energy consumption to increase.

SUMMARY OF THE INVENTION

Accordingly, the present invention is directed to an electric oven and a method of operating the electric oven, which substantially obviate one or more problems due to limitations and disadvantages of the related art.

An object of the present invention is to provide an electric oven that can independently cook food disposed in different compartments of the cavity and a method of operating the electric oven.

Another object of the present invention is to provide an electric oven that can improve the energy efficiency and a method of operating the electric oven.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven including: an oven body; a first convection system having a first convention heater and a first convection fan that are installed in the oven body to operate for a first space in the oven body; and a second convection system having a second convention heater and a second convection fan that are installed in the oven body to operate for a second space in the oven body.

In another aspect of the present invention, there is provided an electric oven including: a cavity; a plurality of convection systems each having a convection heater and a convection fan; and a tray dividing the cavity into different spaces, wherein the convection systems are operated for the respective different spaces.

In still another aspect of the present invention, there is provided a method of operating an electric oven, the method including: preparing an oven body defining a cavity; providing a plurality of convection systems each having a convection heater and a convection fan in the oven body, the convection system being provided for divided spaces in the cavity; and operating independently the convection systems for independent cooking in each space.

According to the present invention, since the convection systems are independently operated for the different compartments of the cavity, the cooking can be independently performed in each compartment. Therefore, the foods can be uniformly heated to improve the cooling quality. In addition, different types of foods can be simultaneously cooked, the cooking time as well as the energy consumption can be reduced.

In addition, since the plurality of convection fans can be driven by a single motor, the structure of the electric oven can be simplified and the manufacturing cost and the number of manufacturing processes can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of an electric oven according to an embodiment of the present invention;

FIG. 2 is a front view of the electric oven of FIG. 1;

FIG. 3 is a front view of an electric oven according to another embodiment of the present invention;

FIG. 4 is a front view of the electric oven according to the present invention, when all of convection systems are operating;

FIG. 5 is a front view of the electric oven according to the present invention, when a part of convection systems is operating; and FIG. 6 is a front view of the electric oven according to the present invention, when a top heater and a part of the convection systems are operating.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

FIG. 1 is an exploded perspective view of an electric oven according to an embodiment of the present invention.

Referring to FIG. 1, an electric oven 1 of this embodiment includes a door 2 and a cavity 30 opened and closed by the door 2. The cavity 30 provides a space in which the food is cooked. The cavity 30 is divided by trays 20 into different compartments, i.e., upper and lower cavities 31 and 32.

The electric oven 1 further includes a first convection system disposed on a rear surface of the upper cavity 31 and a second convection system disposed on a rear surface of the lower cavity 32. Each of the first and second convection systems 50 and 40 has a convection heater and a convection fan. This will be described later.

One or more tray guides 6 for supporting the trays 20 are formed on both side surfaces of the cavity 30. That is, the trays 20 provide surfaces on which the food or container containing the food is disposed. The trays 20 move frontward or rearward in the cavity 30 while being guided by the tray guides 6. As described above, the trays 20 function to divide the cavity 30 into the upper and lower cavities 31 and 32.

A baking heater (not shown) that is a heat source during cooking is disposed on a lower portion of the cavity 30 and a dual-bottom 5 is coupled to an upper portion of the backing heater. The dual-bottom 5 prevents the baking heater from being exposed to an external side, thereby preventing a user from being injured by the baking heater.

Meanwhile, the electric oven 1 further includes a cook top 8, one or more cook top heaters 9 formed on the cook top 8, and a manipulation panel 10 formed on a rear surface of the cook top 8. The cook top heater 9 converts electric energy into heat energy to heat the food contained in the container disposed on the cook top heater 9. A variety of manipulation buttons are placed on the manipulation panel 10 to set an operation mode of the electric oven 1.

FIG. 2 is a front view of the electric oven of FIG. 1.

Referring to FIG. 2, the cavity 30 is formed in the electric oven 1. The cavity 30 is defined by a case 13. The cavity 30 is divided into the upper and lower cavities 31 and 32 by the trays 20. The trays 20 are supported by the tray guides 6. The top heater 14 is formed on the upper portion of the cavity 30.

The first convection system 50 having a first convection heater 51 and a first convection fan 52 is installed on the rear surface of the upper cavity 31. The second convection system 50 having a second convection heater 51 and a first convection fan 52 is installed on the rear surface of the lower cavity 32.

The first and second convection systems 50 and 40 operate independently from each other. That is, when the food baking is performed at both of the first and second cavities 31 and 32, both of the first and second convection systems 50 and 40 operate. Then, ambient air is heated by the first convection heater 51 and is circulated by convection in the upper cavity 31 by the first convection fan 52. By this, the food baking is performed in the upper cavity 31. Likewise, ambient air is heated by the second convection heater 41 and is circulated by convection in the lower cavity 32 by the second convection fan 42.

As described above, when the independent first and second convection systems 50 and 40 operate for the respective upper and lower cavities 31 and 32, the food in the upper and lower cavities 31 and 32 are uniformly heated.

In addition, when the foods in the upper and lower cavities 31 and 32 are different types, the first and second convection systems 50 and 40 can be independently controlled according to the cooking conditions. That is, the independent control can be realized by adjusting the powers of the first and second convection heaters 51 and 41 and the RPMs of the convection fans 52 and 42. When the cooking is independently realized in the upper and lower cavities 31 and 32, the cooking quality of the food can be improved.

In addition, the cooking may be done in only one of the upper and lower cavities 31 and 32. That is, when the cooking is done only in the upper cavity 31, only the first convection system 50 operates. Then, the air only in the upper cavity 31 is locally heated. Therefore, the time for cooking can be reduced and thus the cooking energy can be saved.

When it is intended to simultaneously perform the grilling and baking using the upper and lower cavities 31 and 32, the top heater 14 and the second convection system 40 operate while the first convection system does not operate. Then, the grilling is performed in the upper cavity 31 using heat generated from the top cover 32 and the baking is performed in the lower cavity 32 by the second convection system 40. As a result, the grilling and baking can be simultaneously realized.

FIG. 3 is a front view of an electric oven according to another embodiment of the present invention.

Referring to FIG. 3, the electric oven 1 includes a first convection system 50 having a first convection heater 51 and a first convection fan 52 and a second convection system 40 having a second convection heater 41 and a second convection fan 42.

According to this embodiment, the first and second fans 52 and 42 are driven by a single common motor (not shown). That is, the motor is connected to a driving pulley 60 and the driving pulley 60 is connected to upward and downward belts 61 and 62 that are respectively connected to first and second driven pulleys 63 and 64 that are respectively coupled to a first rotational shaft of the first convection fan 52 and a second rotational shaft of the second convection fan 42.

The operation of the above-described electric fan will now be described.

When electric power is applied, the motor rotates. Then, the driving pulley 60 connected to the motor rotates to operate the upward and downward belts 61 and 62. By the operation of the belts 61 and 62, the first and second driven pulley 63 and 64 rotate to rotate the first and second convection fans 52 and 42.

As described above, since the first and second convection fans 52 and 42 are driven by the single common motor, the structure of the electric oven 1 can be simplified and thus the manufacturing cost and the number of manufacturing processes thereof can be reduced.

FIGS. 4 through 6 show a variety of operations of the electric oven according to the present invention.

FIG. 4 is a front view of the electric oven according to the present invention, when all of the convection systems are operating.

Referring to FIG. 4, when both the first and second convection systems 50 are operating, the baking operations are independently performed at the upper and lower cavities 31 and 32. Therefore, different types of foods can be cooked in the upper and lower cavities 31 and 32. In this case, the first and second convection systems 50 and 40 are independently controlled from each other according to each cooking conditions in the upper and lower cavities 31 and 32.

That is, the independent control can be realized by adjusting the powers of the first and second convection heaters 51 and 41 and the RPMs of the convection fans 52 and 42. When the cooking is independently realized in the upper and lower cavities 31 and 32, the cooking quality of the food can be improved.

FIG. 5 is a front view of the electric oven according to the present invention, when only one of the first and second convection systems is operating.

Referring to FIG. 5, only the first convection system 50 is operating. In this case, the cooking is done only in the upper cavity 31. Then, the air only in the upper cavity 31 is locally heated. Therefore, the time for cooking can be reduced and thus the cooking energy can be saved.

FIG. 6 is a front view of the electric oven according to the present invention, when the top heater and only one of the first and second convection systems are operating.

When it is intended to simultaneously perform the grilling and baking using the upper and lower cavities 31 and 32, the top heater 14 and the second convection system 40 operate while the first convection system does not operate. Then, the grilling is performed in the upper cavity 31 using heat generated from the top cover 32 and the baking is performed in the lower cavity 32 by the second convection system 40. As a result, the grilling and baking can be simultaneously realized.

According to the present invention, since the convection systems are independently operated for the different compartments of the cavity, the cooking can be independently performed in each compartment. Therefore, the foods can be uniformly heated to improve the cooling quality. In addition, different types of foods can be simultaneously cooked, the cooking time as well as the energy consumption can be reduced.

In addition, since the plurality of convection fans can be driven by a single motor, the structure of the electric oven can be simplified and the manufacturing cost and the number of manufacturing processes can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven comprising:

an oven body;

a first convection system having a first convection heater and a first convection fan that are installed in the oven body to operate for a first space in the oven body; and a second convection system having a second convection heater and a second convection fan that are installed in the oven body to operate for a second space in the oven body, wherein the first and second convection fans are driven by a single common driving unit.

2. The electric oven according to claim 1, wherein the first and second spaces are divided by a tray on which food is loaded.

3. The electric oven according to claim 2, wherein the oven body is divided into upper and lower cavities by the tray.

4. The electric oven according to claim 1, wherein the first convection system is provided for an upper space in the oven body and the second convection system is provided for a lower space in the oven body.

5. The electric oven according to claim 1, wherein the single common driving unit is associated with the first and second convection fans by belts.

6. An electric oven comprising:

a cavity;

a plurality of convection systems each having a convection heater and a convection fan; and a tray on which food is loaded dividing the cavity into different spaces, wherein the convection systems are operated for the respective different spaces, and wherein the plurality of the convection fans are driven by a single common driving unit.

7. The electric oven according to claim 6, wherein the different spaces are upper and lower cavities divided by the tray in the cavity.

* * * * *